US009421765B2

(12) United States Patent
Saito et al.

(10) Patent No.: US 9,421,765 B2
(45) Date of Patent: Aug. 23, 2016

(54) METHOD OF MANUFACTURING LIQUID DISCHARGING HEAD

(75) Inventors: Ichiro Saito, Yokohama (JP); Makoto Sakurai, Kawasaki (JP); Takahiro Matsui, Yokohama (JP); Yuzuru Ishida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1098 days.

(21) Appl. No.: 13/043,989

(22) Filed: Mar. 9, 2011

(65) Prior Publication Data

US 2011/0239462 A1 Oct. 6, 2011

(30) Foreign Application Priority Data

Mar. 31, 2010 (JP) ..... 2010-082375

(51) Int. Cl.
*B41J 2/14* (2006.01)
*B41J 2/16* (2006.01)

(52) U.S. Cl.
CPC ..... *B41J 2/14016* (2013.01); *B41J 2/14032* (2013.01); *B41J 2/1603* (2013.01); *B41J 2/1628* (2013.01); *B41J 2/1631* (2013.01); *B41J 2/1639* (2013.01); *B41J 2/1645* (2013.01); *B41J 2/14233* (2013.01); *B41J 2/1629* (2013.01); *Y10T 29/49401* (2015.01)

(58) Field of Classification Search
CPC ..... B41J 2/1601–2/1604; B41J 2/1639; B41J 2/162; B41J 2/1621; B41J 2/1623; B41J 2/1631; B41J 2/14145; B41J 2/1626; B41J 2/1628; B41J 2/1629; B41J 2/14032–2/14064
USPC ..... 29/890.1
See application file for complete search history.

(56) References Cited

U.S. PATENT DOCUMENTS

| | | | | |
|---|---|---|---|---|
| 5,144,536 | A | 9/1992 | Tsukada et al. | |
| 6,145,965 | A | 11/2000 | Inada et al. | |
| 6,897,021 | B2 | 5/2005 | Nagasawa et al. | |
| 7,712,875 | B2 | 5/2010 | Shibata et al. | |
| 7,857,429 | B2 | 12/2010 | Ozaki et al. | |
| 2004/0239729 | A1 * | 12/2004 | Kim et al. | 347/63 |

(Continued)

FOREIGN PATENT DOCUMENTS

| | | |
|---|---|---|
| JP | 3-108796 A | 5/1991 |
| JP | 6-17296 A | 1/1994 |
| JP | 9-1809 A | 1/1997 |
| JP | 9-216371 A | 8/1997 |

(Continued)

OTHER PUBLICATIONS

Office Action dated Jan. 7, 2014, in Japanese Application No. 2010-082375.

*Primary Examiner* — Livius R Cazan
(74) *Attorney, Agent, or Firm* — Fitzpatrick, Cella, Harper & Scinto

(57) ABSTRACT

In a method of manufacturing a liquid discharging head which includes a flow path forming member which has a discharge port for discharging a liquid and a liquid flow path communicating with the discharge port, and a base body having a liquid supply port which supplies the liquid flow path with the liquid, the method includes (1) forming a mold of the liquid flow path and a foundation member formed of a porous inorganic material over the base body, (2) applying an organic resin over the base body so as to cover the mold and the foundation member to form the flow path forming member, (3) forming the discharge port in the flow path forming member to form the liquid supply port in the base body, and (4) removing the mold to form the liquid flow path.

7 Claims, 6 Drawing Sheets

(56) References Cited

U.S. PATENT DOCUMENTS

| | | | | |
|---|---|---|---|---|
| 2005/0191699 | A1 | 9/2005 | Nagasawa et al. | |
| 2008/0245766 | A1* | 10/2008 | Terui | 216/27 |
| 2009/0315956 | A1 | 12/2009 | Ishida et al. | |
| 2010/0220154 | A1 | 9/2010 | Shibata et al. | |

FOREIGN PATENT DOCUMENTS

| | | | |
|---|---|---|---|
| JP | 11-169691 | A | 6/1999 |
| JP | 2002-111149 | A | 4/2002 |
| JP | 2007-290234 | A | 11/2007 |
| JP | 2008-126491 | A | 6/2008 |

* cited by examiner

METHOD OF MANUFACTURING LIQUID DISCHARGING HEAD

BACKGROUND OF THE INVENTION

1. Field of the Invention

The present invention relates to a liquid discharging head for discharging a liquid and a method of manufacturing the same.

2. Description of the Related Art

As a typical example of a liquid discharging head, there is an ink jet recording head which is applied to an ink jet recording method that discharges ink to a recording medium to perform the recording. The ink jet recording head generally includes a flow path of ink, a discharging energy generating portion disposed on a part of the flow path, and a minute discharge port for discharging the ink by energy generated therein.

A method of manufacturing a liquid discharging head capable of being applied to an ink jet recording head is disclosed in Japanese Patent Application Laid-Open No. 2007-290234. In this method, a mold of the flow path is formed on a substrate having a plurality of discharging energy generating portions using a photosensitive material, a vicinity portion mold material is formed around the mold of the flow path, and an applying resin layer becoming a flow path wall member forming the wall of the flow path is applied thereon. By providing the vicinity portion mold material, the covering properties in the corner portions of the mold of the flow path are improved. Moreover, at positions of the covering layer facing the respective discharging energy generating portions, spaces becoming the flow paths are formed by forming openings becoming the plurality of discharge ports and then removing the mold.

However, a chemical affinity between the resin and the substrate is not substantially strong, and there is a concern that peeling may occur between the flow path wall member and the substrate depending on the size of the liquid discharging head or the environment during use, whereby there is a possibility that the reliability becomes insufficient.

SUMMARY OF THE INVENTION

The invention was made in view of the above, and an object thereof is to provide a liquid discharging head which has an excellent adhesion property with the base body of the flow path forming member and has a highly reliable discharging capability.

According to an example of the invention, there is provided a manufacturing method of a liquid discharging head which includes a flow path forming member which has a discharge port for discharging a liquid and a liquid flow path communicating with the discharge port, and a base body having a liquid supply port which supplies the liquid flow path with the liquid, the method including: (1) forming a mold of the liquid flow path and a foundation member consisting of a porous inorganic material over the base body; (2) applying an organic resin over the base body so as to cover the mold and the foundation member to form the flow path forming member; (3) forming the discharge port in the flow path forming member to form the liquid supply port in the base body; and (4) removing the mold to form the liquid flow path.

The invention is directed to a liquid discharging head which has an excellent adhesion property between the flow path forming member and the base body and has a highly reliable discharging capability.

Further features of the invention will become apparent from the following description of exemplary embodiments with reference to the attached drawings.

DESCRIPTION OF THE EMBODIMENTS

Preferred embodiments of the invention will now be described in detail according to the accompanying drawings.

Hereinafter, an embodiment of a liquid discharging head will be described. Furthermore, in the following description, an ink jet recording head as an application example of the invention will be described, but an application scope of the invention is not limited thereto, but is also able to be applied to a liquid discharging head that is used in one of bio chip manufacturing and electronic circuit printing. As the liquid discharging head, in addition to the ink jet recording head, for example, a head for manufacturing a color filter is also able to be adopted.

(First Embodiment)

Hereinafter, an embodiment of the invention will be described with reference to the drawings.

Figure 1:
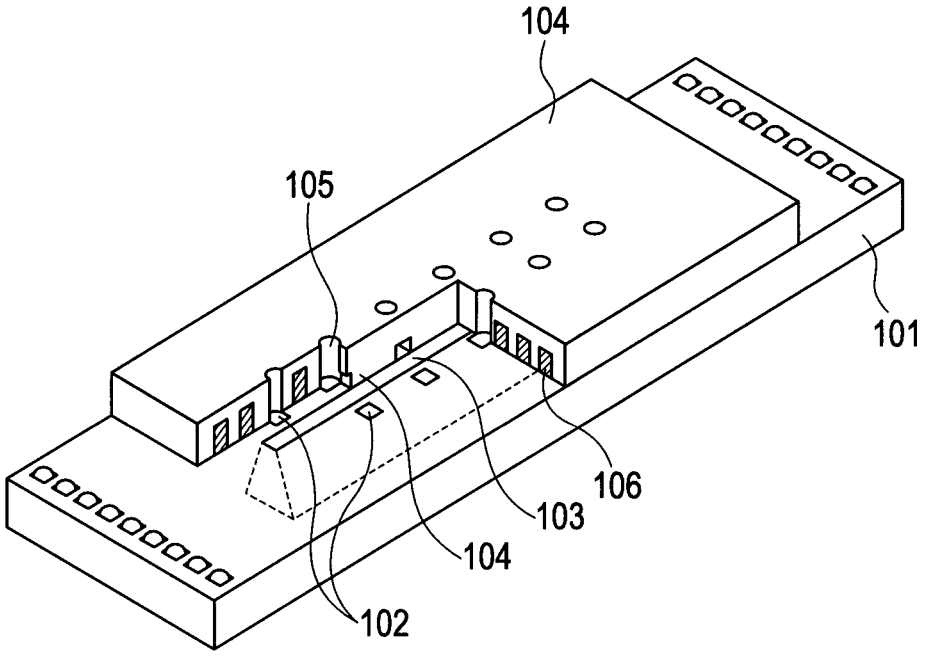
FIG. 1 is a schematic perspective view that illustrates a liquid discharging head of the present embodiment.

FIG. 1 is a schematic perspective view that illustrates a liquid discharging head of the present embodiment. In the liquid discharging head illustrated in FIG. 1, on a base body 101 formed with a thermal action portion 102, a flow path forming member (an orifice plate) 104 having a discharge port 105 is formed. The flow path forming member 104 is disposed on the base body 101 so that top and bottom positions of the thermal action portion 102 and the discharge port 105 correspond to each other. In the base body 101, a liquid supply port 103 for supplying the liquid flow path with liquid such as ink is formed. In the flow path forming member 104, a discharge port 105, and a liquid flow path, through which the discharge port 105 communicates with the liquid supply port 103, are formed. In addition, in FIG. 1, two rows of discharge ports 105 are disposed line symmetrically, but the resolution of the recording is able to be further improved by disposing two rows of discharge ports 105 in a staggered manner by half a pitch.

Furthermore, there is provided a foundation member 106 that is formed of an inorganic material, a lower surface of the foundation member is in contact with an upper surface (a surface) of the base body 101, and other surfaces thereof are covered with the flow path forming member 104. That is, the foundation member 106 is formed using the inorganic material so as to be covered with the flow path forming member 104 over the base body 101. Furthermore, the foundation member 106 has unevenness on a surface thereof that comes into contact with the flow path forming member 104.

In the past, generally, in order to improve the adhesion property, a method of reforming the substrate surface using plasma has been attempted. However, in the base body used in the liquid discharging head, a driving element is formed on the substrate, and there is a possibility that damage occurs by performing the etching using plasma and the like, whereby there is a limitation in reforming the surface using plasma.

Thus, in the invention, by providing the foundation member having the unevenness on the surface thereof over the base body, the adhesion property between the flow path forming member and the base body is improved. When an organic resin, which is a material of the flow path forming member, is covered over the foundation member, the organic resin permeates the unevenness existing on the surface of the foundation member and the surface area to be adhered increases, whereby a stronger adhesion property is provided. In addition, if the foundation member exists, it is possible to increase the adhesion area between the foundation member and the flow path forming member. Thus, it is possible to obtain a stronger adhesion force between the base body and the flow path forming member, whereby an occurrence of peeling or the like is able to be suppressed.

Furthermore, in the liquid discharging head according to the invention, since the member constituting the liquid flow path is formed of an organic resin, a tolerance to a liquid of ink is excellent and the reliability is high.

Thus, as compared to the liquid discharging head in which the organic resin is applied or bonded to the base body to form the flow path forming member as in the related art, the liquid discharging head of the invention is stable in regard to external factors such as humidity change, temperature change, and mechanical pressure, and has high reliability.

Moreover, in the liquid discharging head according to the invention, resin permeates the unevenness of the foundation member, whereby a flow path forming member having relatively little stress is able to be formed, and the deformation of the chip is suppressed by the use of the base body, whereby it is possible to provide the liquid discharging head that accommodates increasing numbers of nozzles and increasing lengths.

Figure 2:
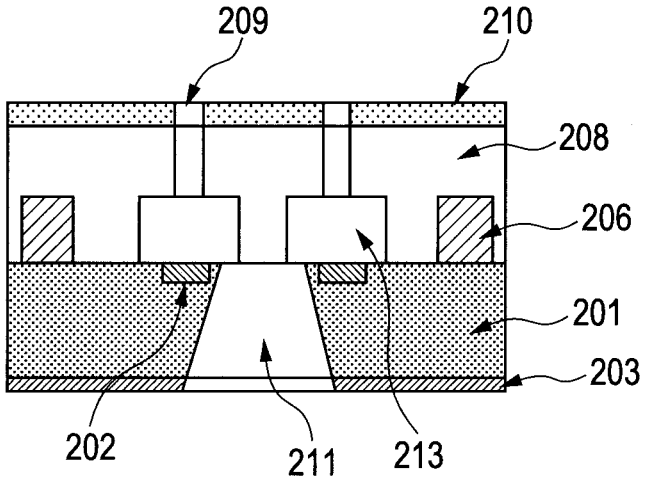
FIG. 2 is a schematic cross-sectional view of a liquid discharging head of the present embodiment.

FIG. 2 illustrates a schematic cross-sectional view of the liquid discharging head of the present embodiment. As illustrated in FIG. 2, a foundation member 206 formed of an inorganic material is formed on the base body 201. Furthermore, a flow path forming member 208 is formed so as to cover the foundation member 206 on the base body 201 and forms the liquid flow path 213. That is, the foundation member is formed inside the flow path forming member on the base body 201.

An inorganic material constituting the foundation member is not particularly limited if it is an inorganic material, but the material is preferably formed of at least one kind of material selected from a metal, a metal oxide, a metal nitride, and a metal carbide. Specifically, for example, the material is preferably formed of a metal such as Au, Cu, Al or Ti; their oxides, nitrides or carbides; or a mixture thereof. As an inorganic material, for example, a sintered body (a ceramic material) is able to be adopted, which has a metal oxide as a basic ingredient and has been baked and hardened by heat treatment at a high temperature. Furthermore, as the inorganic material, a composite material (a cermet material) is able to be adopted in which a powder of a hard compound such as a carbide or a nitride of the metal is mixed with a binding material of the metal and is sintered.

By forming the foundation member using the inorganic material, for example, it is possible to form the substrate formed of an inorganic material such as Si with physical properties such as heat conductivity, a thermal expansion coefficient, a moisture absorption coefficient, and a mechanical property, which are approximate to those able to improve the adhesion property between the base body and the foundation member.

Furthermore, the foundation member in the invention has unevenness on the surface coming into contact with the flow path forming member. The organic resin permeates the unevenness and is hardened, whereby the flow path forming member is able to firmly come into close contact with the foundation member. Thus, the flow path forming member is not peeled off from the base body, due to external factors such as humidity change, temperature change, and mechanical pressure.

As a method of forming the foundation member having the unevenness, a method of directly forming the above-mentioned inorganic material on the base body, and then giving the surface the unevenness is able to be adopted. For example, by disposing the foundation member formed of the inorganic material on the base body and then treating the same using a solution such as sulfuric acid, phosphoric acid, nitric acid, or hydrofluoric acid, or a mixture thereof, the unevenness is able to be formed on the surface of the foundation member.

Furthermore, by forming the foundation member using a porous glass, the foundation member having the unevenness is able to be formed. That is, the glass ingredient is selected as the inorganic material to form the foundation member, and then the same is subjected to an acid treatment or the like to become porous, whereby the foundation member having the unevenness is able to be formed. More specifically, for example, by applying $Na_2O$—$B_2O_3$—$SiO_2$ based glass on the base body, performing heat treatment, for example, at 300° C. and then immersing the same in the acid solution, a porous glass having an $SiO_2$ framework is able to be formed. In addition, as a glass ingredient, CaO, PbO, $Al_2O_3$, $L_2O$, or the like is able to be adopted.

Furthermore, in the case of forming the foundation member using the porous glass, the porosity is preferably greater than or equal to 30%. By setting the porosity to greater than or equal to 30%, the unevenness is able to be effectively formed by the foundation member. Furthermore, the porosity is preferably less than or equal to 70%.

Furthermore, in addition, as a method of forming the foundation member having the unevenness, it is possible to adopt a method of forming the same so that the surface thereof has the unevenness at the time of the film formation. Specifically, for example, it is possible to adopt a complex plating method which contains a polymer particle as a dispersion material, an oblique deposition method of forming a film with an oblique direction with respect to the base body, or a spraying method of mixing and melting the metal and ceramic and emitting them while atomizing them using air or the like from a compressor to form a film.

As the complex plating method, there is a method of adding an acryl polymer particle into a bath of nickel plating material as a dispersion material, and performing the plating, and then performing heat treatment, thereby performing the decomposition and breakaway, or a method of melting and removing by immersion treatment with a solvent.

As the oblique deposition method, there is a method of performing a film growth having directivity by attaching airborne particles to the substrate from the oblique direction at the time of forming Ti, Al, Cu, Au, or the like, thereby forming the porous film.

The disposition shape of the foundation member may be disposed within the scope of not affecting the discharging (not hindering the heater portion, the flow path portion, or the like), and although it is not particularly limited, it is desirable to dispose the same so that the contact area becomes larger so as to enable strong adhesion to be secured between the same and the base body.

Furthermore, in order to further improve the adhesion property between the flow path forming member and the foundation member, it is desirable that the thickness of the foundation member is greater than or equal to 30% and less than or equal to 90% of the thickness of the flow path forming member. By setting the thickness to be greater than or equal to 30%, the contact area with the flow path forming member is able to be suitably secured and the adhesion property is able to be further improved. By setting the thickness to be less than or equal to 90%, the covering property of the foundation member by the flow path forming member is able to be improved. Furthermore, it is desirable that the height of the foundation member is greater than or equal to that of the liquid flow path.

Moreover, in order to prevent peeling or deformation caused by humidity change, temperature change, mechanical pressure, or the like, it is desirable that the contact area between the base body and the foundation member is greater than or equal to 30% and less than or equal to 60% of the contact area between the base body and the flow path forming member. By setting the contact area to be greater than or equal to 30%, the foundation member is able to be more strongly fixed to the base body. By setting the contact area to be less than or equal to 60%, the covering property of the foundation member by the flow path forming member is able to be improved.

As an organic resin becoming a material of the flow path forming member 208, for example, a photosensitive epoxy resin, a photosensitive acryl resin, or the like is able to be used.

Furthermore, by applying the organic resin so as to cover the foundation member on the base body under vacuum and then returning the same to the atmosphere, it is possible to effectively cause the organic resin, which is a material of the flow path forming member, to permeate the unevenness of the foundation member.

(Second Embodiment)

FIGS. 3A to 3I are cross-sectional process charts for describing the manufacturing process of the liquid discharging head described in FIG. 2. Hereinafter, the manufacturing process of the ink jet recording head will be described as an example, but the invention is not limited thereto.

Firstly, a base body 301 is prepared in which a heating portion 302 becoming a thermal action portion is formed on a surface side. On a silicon oxidation film 303 formed on a back surface side of the base body, a first patterning mask 304 having an alkali resistance for forming an ink supply port (a liquid supply port) 311 is formed (see FIG. 3A).

The first patterning mask 304 is able to be formed, for example, as follows: firstly, a mask agent is applied to the back surface of the base body 301 by a spin coating method or the like and is subjected to heat-hardening. Next, a positive type resist (not illustrated) is applied thereon by the spin coating method or the like and is dried. Next, the positive type resist is patterned by a photolithography technique, and an exposed portion of the mask agent is removed by a dry etching method using the positive type resist as a mask. Moreover, the positive type resist is peeled off to obtain a first patterning mask 304 having a desired pattern shape.

Next, on the surface side of the base body 301 formed with the heating portion 302, a mold material 305 is formed, for example, using Al. The mold material 305 is formed at a suitable height and with a plane surface pattern so as to form the ink flow path. Next, an inorganic material 306*a* is formed over the mold material 305 and the base body 301 (FIG. 3B). In this embodiment, as the inorganic material, for example, porous glass may be used. For example, by applying $Na_2O—B_2O_3—SiO_2$ based glass, performing the heat treatment at 300° C., and then immersing the same in the acid solution, a porous glass having a $SiO_2$ framework is able to be formed. In addition, it is desirable to cover a wafer by a protective member so as not to affect other members and then to treat the wafer upon being immersed into the acid solution. As a mold material, a material may be adopted which is able to be eluted in the succeeding process, and in addition to the inorganic material such as Al, a photosensitive resin soluble in the solvent may be used.

Figure 3A:
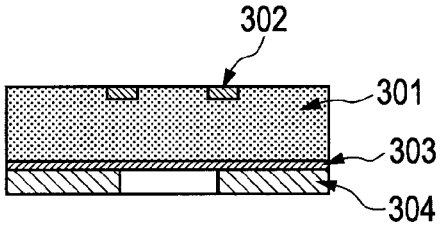
FIGS. 3A, 3B, 3C, 3D, 3E, 3F, 3G, 3H and 3I are cross-sectional process charts for describing process examples that manufacture the liquid discharging head of the invention.
Figure 3B:
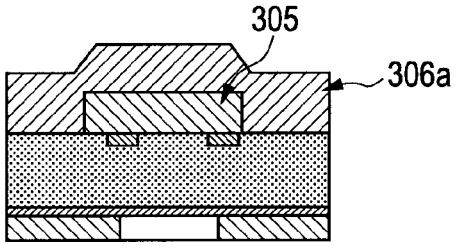
Figure 3C:
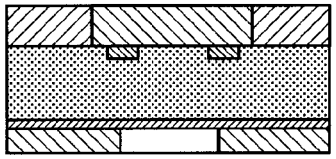

Next, surface polishing is performed by a CMP (Chemical and Mechanical Polishing) method to perform the planarization (FIG. 3C).

Figure 3D:
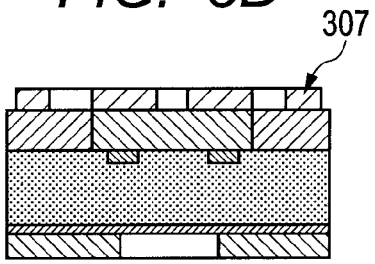

Next, a second patterning mask 307 is formed over the mold material 305 and the inorganic material 306*a* (FIG. 3D). The second patterning mask 307 is able to be formed by the photolithography technique using a resist.

Figure 3E:
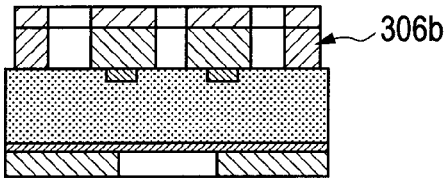

Next, the mold material 305 and the inorganic material 306*a* are removed by dry etching or the like using a second patterning mask 307 to form a flow path pattern 305 and a foundation member 306*b* (FIG. 3E).

A distance between the side surface of the foundation member and the side surface of the flow path pattern is, preferably, for example, 1 to 20 μm, and, preferably, 2 to 10 μm.

Figure 3F:
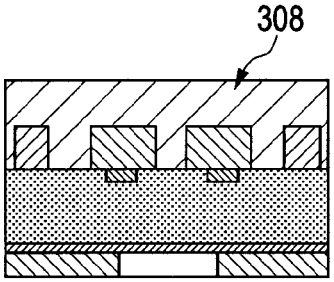

Next, after the second patterning mask 307 is removed, a flow path forming member 308 is formed so as to cover the flow path pattern 305 and the foundation member 306*b* (FIG. 3F). The flow path forming member 308 is able to be formed by applying the resin material using the spin coating method or the like and patterning the same to a desired shape by the photolithography technique.

Figure 3G:
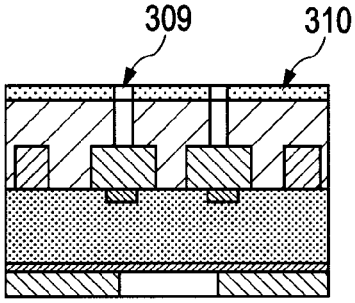

Next, a water repellent layer 310 is formed on the surface of the flow path forming member 308 using a laminate or the like of a dry film. Moreover, an ink discharge port 309 is formed at a position facing the heating portion 302 by the photolithography technique (FIG. 3G).

As a material of the flow path forming member 308, for example, a photosensitive epoxy resin, a photosensitive acryl resin, or the like is able to be used. Since the flow path forming member 308 constitutes the ink flow path and always comes into contact with the ink at the time of using the ink jet recording head, as the material thereof, particularly, a cationically polymerizable compound by the photoreaction is suitable. Furthermore, as a material of the flow path forming member 308, since the durability thereof greatly depends on the kinds and characteristics of the ink to be used, a suitable compound other than the above-mentioned material may be selected depending on the ink to be used.

Figure 3H:
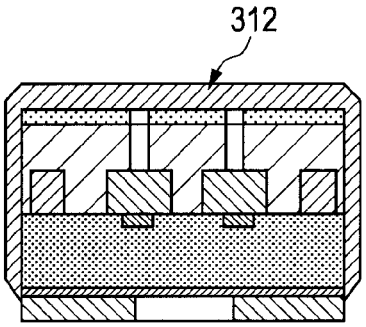

Next, in order that the etching liquid does not come into contact with the surface formed by the functional element of the ink jet recording head or the side surface of the base body 301, these portions are covered by spin coating or the like using a protective material 312 formed of resin (FIG. 3H). As a material of the protective material 312, a material is used which has a sufficient tolerance to a strong alkali solution that is used upon performing anisotropic etching. By covering the flow path forming member 308 using such a protective material 312, the deterioration of the water repellent layer 310 is able to be prevented.

Figure 3I:
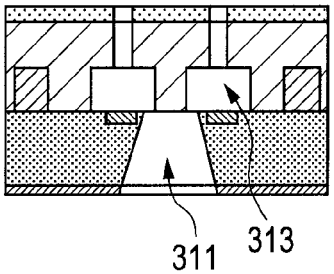

Next, the silicon oxidation film 303 is patterned by wet etching or the like using the first patterning mask 304, thereby forming an etching starting opening portion to which the back surface of the base body 301 is exposed. Moreover, an ink supply port 311 is formed by the anisotropic etching by using the silicon oxidation film 303 as the mask. As an etching liquid used in the anisotropic etching, for example, 22 mass % solution of TMAH (tetramethylammonium hydroxide) is able to be used. Furthermore, by performing the etching for a predetermined time (several tens of hours) while maintaining the temperature of the solution at 80° C., a through hole is able to be formed. Thereafter, the protective material 312 and the first patterning mask 304 are removed. Moreover, the flow path pattern 305*b* is eluted and removed from the ink discharge port 309 and the ink supply port 311 and a liquid flow path 313 is formed, thereby manufacturing an ink jet recording head (FIG. 3I).

The flow path pattern 305 is able to be eluted using a mixed acid C-6 (a mixed liquid of phosphoric acid, acetic acid, nitric acid, and water) or the like. Furthermore, the flow pattern 305*b* is able to be removed using ultrasonic immersion as necessary.

Figure 4:
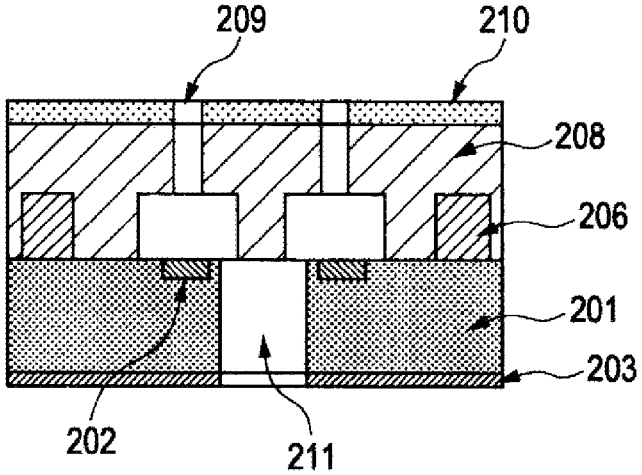
FIG. 4 is a schematic cross-section view of the liquid discharging head of the present embodiment.

Furthermore, in FIGS. 3A to 3I, an example is illustrated which forms the ink supply port by wet etching using TMAH, but, as illustrated in FIG. 4, an ink supply port may be formed in a vertical shape using dry etching. Otherwise, an ink supply port may be formed by laser or sand blast etching.

The liquid discharging head manufactured by the above process has the following characteristics: that is, in the invention, by providing the foundation member having the unevenness on the surface on the base body, the adhesion property between the flow path forming member and the base body is improved. When covering the organic resin, which is the material of the flow path forming member, on the foundation member, the organic resin permeates the unevenness existing on the surface of the foundation member, the surface area to be adhered increases, and a stronger adhesion property is provided. In addition, when the unevenness exists on the whole surface of the foundation member formed on the base body, since it is possible to provide a portion which comes into close contact with the organic resin in the surface direction as well as the vertical direction and the contact area is able to be increased, a strong adhesion force is able to be obtained. For that reason, even if swelling or thermal change occurs in the resin, since the flow path forming member is strongly fixed to the base body by the foundation member, the deformation of the chip is able to be suppressed. Thus, as compared to the liquid discharging head in which the organic resin is applied or bonded to the base body to form the flow path forming member as in the related art, the liquid discharging head of the invention is stable with regard to external factors such as humidity change, temperature change, or mechanical pressure, and has high reliability.

Furthermore, in the liquid discharging head according to the invention, since the member constituting the liquid flow path is formed of resin, the member has excellent tolerance to the liquid such as ink and has high reliability. In addition, in the liquid discharging head according to the invention, since the deformation of the chip is suppressed, it is possible to effectively cope with an increasing number of nozzles or increasing lengths.

Furthermore, the base body for the liquid discharging recording head of the invention may be manufactured by a process of, for example, forming an ink supply port at the step of FIG. 3F and then forming an ink discharge port without being limited to the manufacturing method of FIGS. 3A to 3I.

(Third Embodiment)

In a third embodiment, a method of disposing a porous inorganic material on the base body using an anodic reaction of aluminum will be described with reference to FIGS. 3A to 3I, FIGS. 10A and 10B.

Figure 10A:
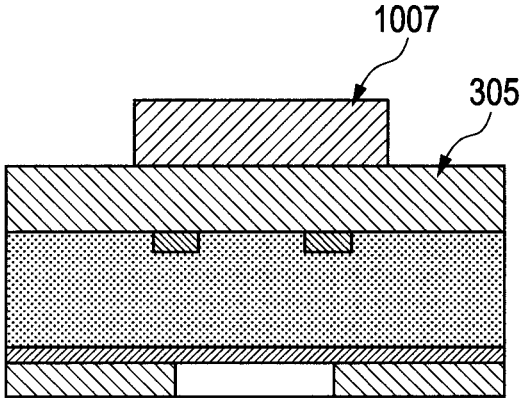
FIGS. 10A and 10B are cross-sectional process charts that describe a process of making an inorganic material used in a foundation member in the invention porous.

Firstly, the mold material 305 formed of aluminum on the base body illustrated in FIG. 3A is formed by a sputtering method. A mask material 1007 is formed thereon by patterning (FIG. 10A).

Figure 10B:
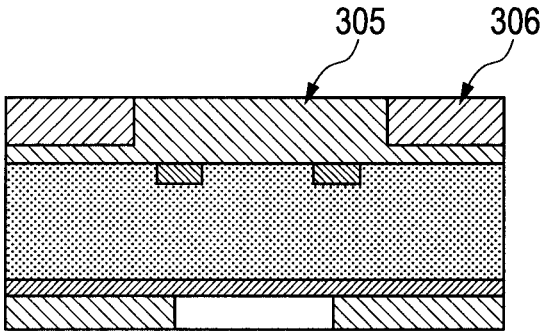

Next, aluminum on the base body provided in an electrolysis liquid is connected to an anode, a counter electrode in the electrolyte liquid is connected to a cathode, and an anodic reaction is performed. By the anodic reaction, in the mold material portion of the portion that is not covered with the mask material 1007, the film thickness of aluminum increases, for example, by about 40%, and thus the surface thereof becomes porous. The porosity is able to be manufactured so that the surface has the depth of several tens of μm at a cycle of several μm. Thereafter, the mask material 1007 is removed (FIG. 10B).

In addition, when the anodic reaction is performed, a treatment (not illustrated) is performed after the wafer is covered by the protective member so as not to affect other members.

Figure 9:
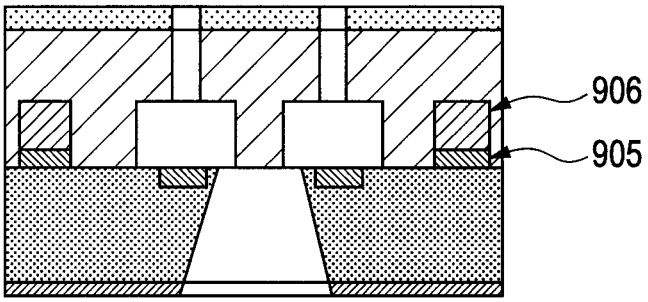
FIG. 9 is a schematic cross-sectional view of a liquid discharging head of the present embodiment.

After that, by treating similarly to the processes of FIGS. 3D to 3I, a liquid discharging head of FIG. 9 is able to be obtained. In the liquid discharging head that is able to be obtained in the invention, as illustrated in FIG. 9, the foundation member is formed of an aluminum portion 905 and a porous aluminum portion 906.

(Fourth Embodiment)

In the present embodiment, the method in which the foundation member that is formed using an oblique deposition method will be described.

A metal such as Ti, Al, Cu, and Au was deposited to the base body from an oblique direction, thereby forming an film with a porous state having a pillar shape in a film thickness direction.

After that, a liquid discharging head was obtained similarly to the processes of FIG. 3C to 3I.

(Fifth Embodiment)

Next, a cartridge type unit (see FIG. 5) in which an ink jet recording head is integrated with an ink tank, and an ink jet recording device (see FIG. 6) using the same will be described.

Figure 5:
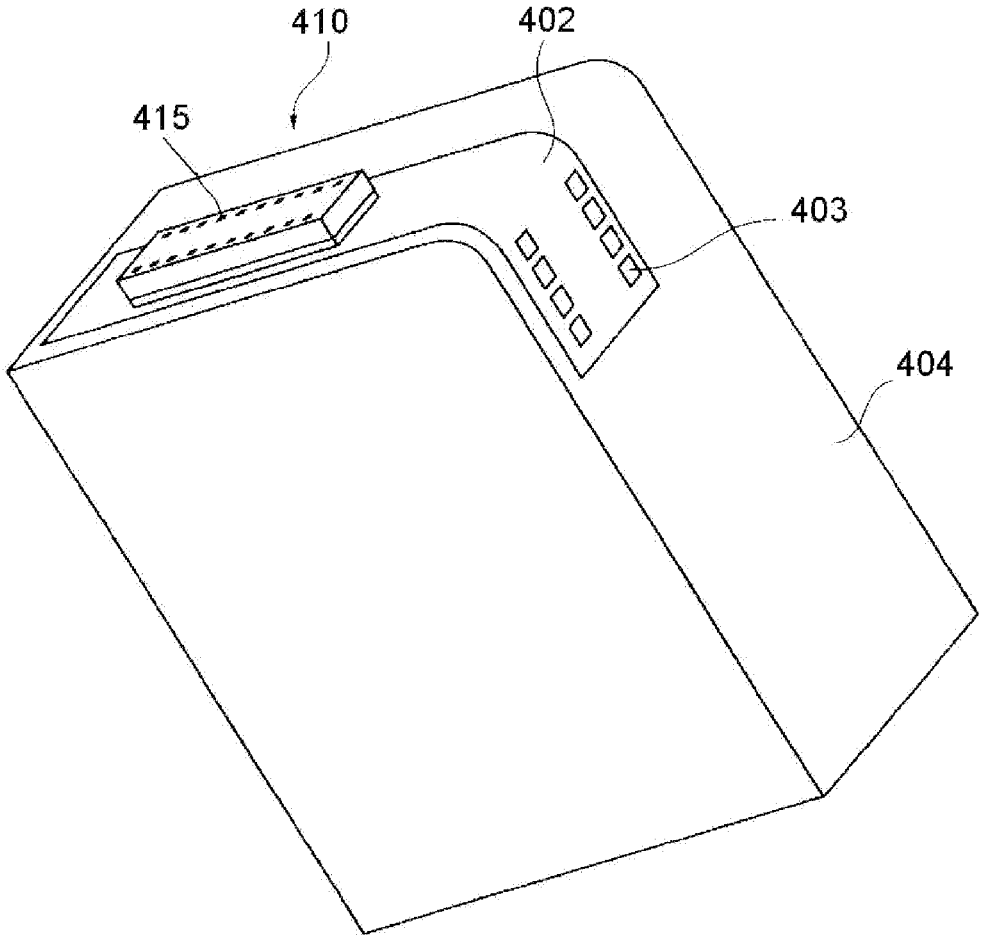
FIG. 5 is a perspective view that illustrates an ink jet cartridge which is configured by using the liquid discharging head of the present embodiment.

FIG. 5 illustrates a configuration example of an ink jet recording head unit 410 having a mold of a cartridge mountable on a recording device. An ink jet recording head 415 is disposed in the ink jet recording head unit 410. The ink jet recording head 415 is disposed in a tape member 402 for a TAB (Tape Automated Bonding) having a terminal for supplying the electric power and is joined to the ink tank 404. The wiring of the ink jet recording head 415 is connected to the wiring (not illustrated) that is extended from a terminal 403 of the tape member 402 for the TAB.

Figure 6:
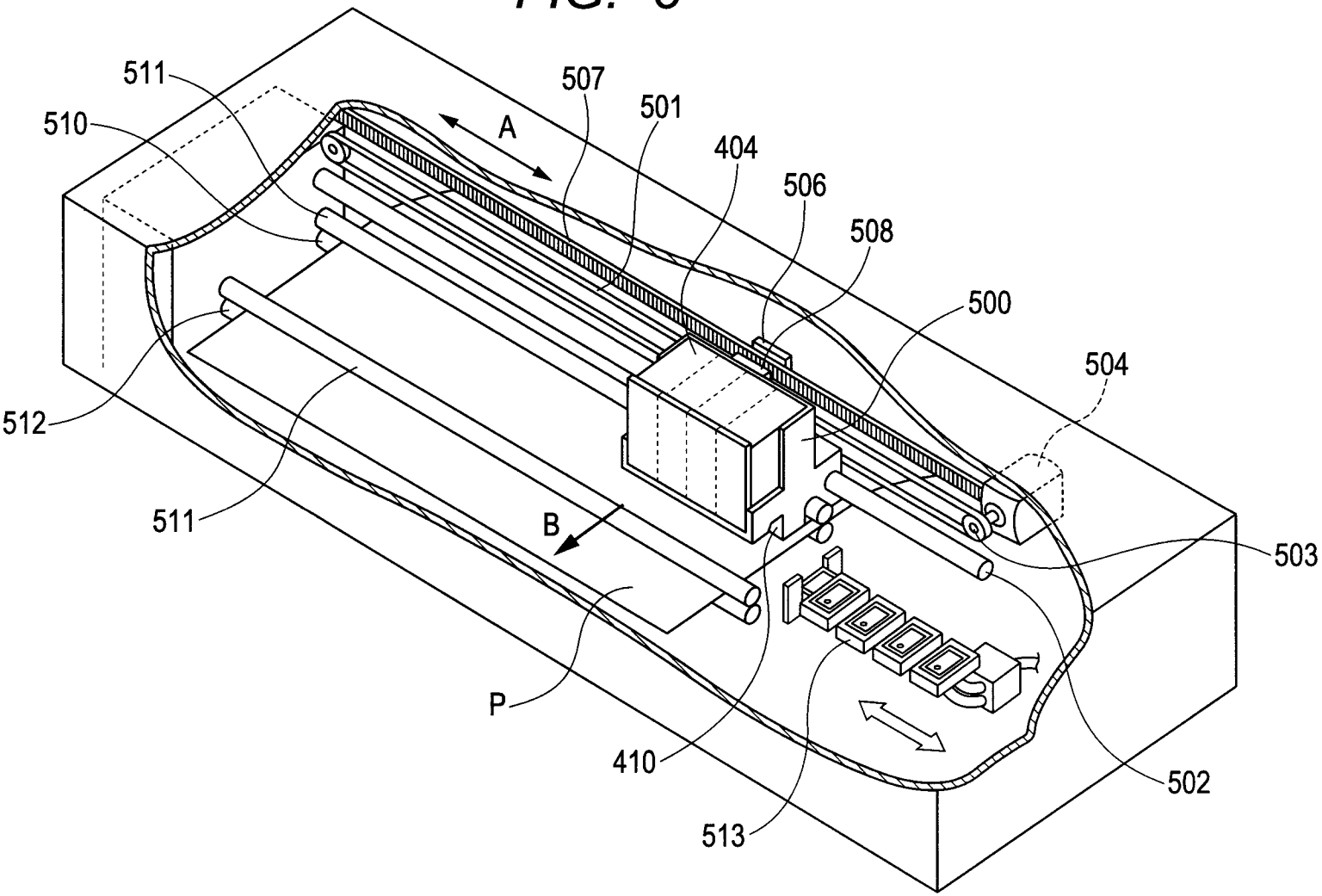
FIG. 6 is a schematic perspective view that illustrates a schematic configuration example of an ink jet print device which uses the ink jet cartridge illustrated in FIG. 5.

FIG. 6 illustrates a schematic configuration example of an ink jet recording device which performs the recording using an ink jet recording head unit of FIGS. 3A to 31.

In the ink jet recording device, a carriage 500 fixed to an endless belt 501 is subjected to main scanning along a guide shaft 502 in a reciprocating direction (A direction in the drawings) along with the rotation driving of a motor 504.

On the carriage 500, an ink jet recording head unit 410 of a cartridge form is mounted. The number of groups of the ink jet recording head unit 410 and the ink tank 404 is able to be provided so as to correspond to the used ink color, and in the illustrated example, four groups are provided so as to correspond to four colors (for example, black, yellow, magenta, and cyan).

The recording paper P as a recording medium is intermittently transported in an arrow B direction which is orthogonal to the scanning direction of the carriage 500.

With such a configuration, the recording of the whole paper P is performed, while alternately repeating the recording of the width corresponding to an arrangement width of the discharge port of the ink jet recording head unit 410 and the transportation of the paper P along with the movement of the carriage 500.

Furthermore, the ink jet recording head is able to be mounted on a device such as a printer, a copier, a facsimile having a communication system, a word processor having a printer portion, and an industrial recording device which is complexly combined with various processing devices. Moreover, by the use of the ink jet recording head, it is possible to perform the printing on various recording media such as paper, a thread, a fiber, a linen and silk, leather, a metal, a plastic, a glass, wood, and ceramics.

Furthermore, in the present specification, the term "recording" refers to not only giving the recording medium an image that has the meaning of a character, a figure or the like, but also giving the recording medium an image that does not have the meaning of a pattern or the like.

(First Example)

In the present example, a liquid discharging head having a foundation member of a cross-sectional shape illustrated in FIG. 3I was manufactured by the process illustrated in FIGS. 3A to 3I.

(Second Example)

Figure 7:
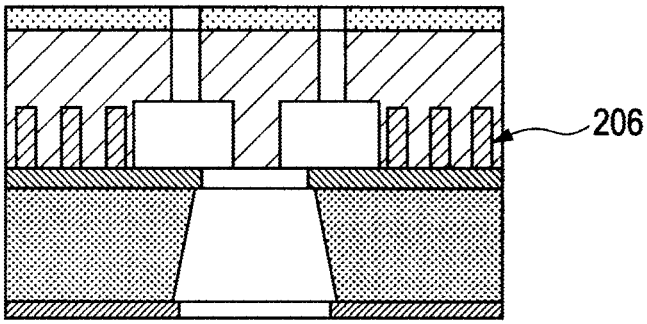
FIG. 7 is a schematic cross-sectional view of a liquid discharging head of the present embodiment.

In the present example, as illustrated in FIG. 7, the foundation member was formed in a rectangular shape. The foundation member was manufactured by forming the second patterning mask in a shape of a divided pattern in the first example. In the present example, the foundation member was formed so that the contact area between the foundation member and the base body was about 40% of the contact area between the flow path forming member and the base body. Furthermore, the foundation member was formed so that the thickness thereof was about 50% of that of the flow path forming member. By such a configuration, it is possible to fix the flow path forming member more strongly to the base body.

(Third Example)

Figure 8:
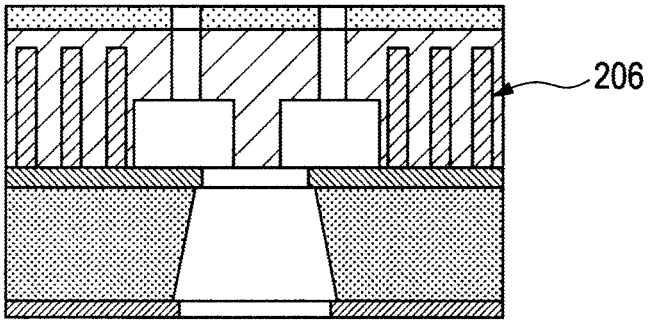
FIG. 8 is a schematic cross-sectional view of a liquid discharging head of the present embodiment.

In the present embodiment, as illustrated in FIG. 8, the foundation member was formed in a rectangular shape, and the foundation member was formed so that the thickness thereof is about 85% of that of the flow path forming member. The configuration was manufactured by increasing the thickness of the inorganic material to be disposed on the base body. In the present embodiment, the foundation member was formed so that the contact area between the foundation member and the base body is about 35% of the contact area between the flow path forming member and the base body. By such a configuration, it is possible to more strongly fix the flow path forming member to the base body.

(Fourth Embodiment)

In the present embodiment, the liquid discharging head was manufactured similarly to the first embodiment except that the foundation member was manufactured using the process illustrated in the third embodiment.

(Fifth Embodiment)

In the present embodiment, the liquid discharging head was manufactured similarly to the first embodiment except that the foundation member was manufactured using the process illustrated in the fourth embodiment.

The inorganic material was formed using an oblique deposition method. A metal such as Ti, Al, Cu, and Au was deposited to the base body from an oblique direction, thereby forming a film of a porous state having a pillar shape in a film thickness direction.

<Head Property>

The ink jet recording head manufactured in the first to fifth embodiments was attached to an ink jet recording device, the measurement of the bubbling start voltage Vth starting the discharging, and a printing endurance test were performed. The test was performed by recording a general test pattern built into the ink jet recording device on paper of A4 size. At this time, the bubbling start voltage Vth was obtained by providing a pulse signal having a driving frequency of 15 KHz and a driving pulse width of 1 μs. In the first embodiment, Vth was 18.0 V.

Next, by setting the voltage of 1.3 times Vth as the driving voltage Vop, the recording of the standard document of 1,500 letters was performed. In any head, it was confirmed that the recording over 5,000 sheets or more is possible, and the deterioration of the recording quality was also not observed.

Next, the printing was similarly performed in a state in which ink was input after preserving the recording head in an environment of 60° C. for two months. Even in any head of the first to fifth embodiments, it was confirmed that the recording was possible, and the deterioration of the recording quality was not observed. That is, it was understood that, in the ink jet recording head to which the invention is applied, the image is stable for a long period of time and the endurance property is also excellent.

While the invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-082375, filed Mar. 31, 2010, which is hereby incorporated by reference herein in its entirety.

What is claimed is:

1. A method of manufacturing a liquid discharging head which includes a flow path forming member which has a discharge port for discharging a liquid and a liquid flow path communicating with the discharge port, and a base body having a liquid supply port which supplies the liquid flow path with the liquid, the base body having a heating portion for discharging the liquid, the method comprising:

(1) forming a mold of the liquid flow path and a foundation member including a porous inorganic material over the base body, the foundation member being of a single layer and having unevenness, wherein the foundation member does not serve an electrical function for the heating portion;

(2) applying an organic resin over the base body so as to cover the mold and the foundation member to form the flow path forming member, the organic resin permeating the unevenness;

(3) forming the discharge port in the flow path forming member and forming the liquid supply port in the base body; and (4) removing the mold to form the liquid flow path, wherein the thickness of the foundation member is greater than or equal to 30% and less than or equal to 90% of the thickness of the flow path forming member.

2. The method according to claim 1, wherein, in the process (1), the foundation member is formed by a process that includes disposing at least one type of material selected from Au, Cu, Al, and Ti on the base body, and a process of treating a surface of the material using a solution including sulfuric acid, phosphoric acid, nitric acid, or hydrofluoric acid or a mixture thereof.

3. The method according to claim 1, wherein the foundation member is formed by a process which includes applying $Na_2O—B_2O_3—SiO_2$ based glass ingredient on the base body, and a process of immersing the glass ingredient in an acid solution after being subjected to a heat treatment to render the glass ingredient a porous glass.

4. The method according to claim 3, wherein the process (1) includes forming a material of the mold on the base body, a process of forming the porous glass on the material of the mold, planarization of the porous glass until the material of the mold is exposed, and forming a flow path pattern and the foundation member by forming and etching a patterning mask over the material of the flow path pattern and the porous glass.

5. The method according to claim 1, wherein, in the process (1), the foundation member is formed by a process which includes disposing aluminum on the base body, and rendering the surface of the aluminum porous by an anodic oxidation reaction.

6. The method according to claim 1, wherein the process (1) includes depositing aluminum on the base body, rendering a portion for forming the foundation member porous by anodic oxidation reaction, and forming the foundation member from the porous aluminum and a flow path pattern formed of aluminum by forming a patterning mask on the aluminum and etching the aluminum using the mask.

7. The method according to claim 1, wherein the unevenness of the foundation member is formed on a surface opposite to a surface opposed to the base body.

* * * * *